US006199330B1

(12) United States Patent
Cobb

(10) Patent No.: US 6,199,330 B1
(45) Date of Patent: Mar. 13, 2001

(54) SKYLIGHT PROTECTOR

(76) Inventor: Charles L. Cobb, 4700 E. Ferguson Ave., Ponca City, OK (US) 74604

( * ) Notice: Subject to any disclaimer, the term of this patent is extended or adjusted under 35 U.S.C. 154(b) by 0 days.

(21) Appl. No.: 09/378,954

(22) Filed: Aug. 23, 1999

(51) Int. Cl.[7] ..... E06B 3/26
(52) U.S. Cl. ..... 52/202; 52/200; 49/57
(58) Field of Search ..... 52/200, 202, 3, 52/63; 49/57, 55, 50; 160/90, 89

(56) References Cited

U.S. PATENT DOCUMENTS

| | | | | |
|---|---|---|---|---|
| D. 354,817 | | 1/1995 | Kovacs et al. | D25/53 |
| 1,236,008 | | 8/1917 | Rysdon . | |
| 2,485,473 | * | 10/1949 | Bishop | 52/3 |
| 2,608,942 | * | 9/1952 | Smith | 52/3 |
| 5,237,788 | | 8/1993 | Sandow | 52/200 |
| 5,419,090 | * | 5/1995 | Sandow | 52/200 |
| 5,502,934 | | 4/1996 | Coyne et al. | 52/200 |
| 5,768,827 | * | 6/1998 | Hackett | 49/50 |
| 5,944,040 | * | 8/1999 | Jang | 135/126 |
| 6,009,929 | * | 1/2000 | Linderman et al. | 49/50 |
| 6,014,845 | * | 1/2000 | Jain et al. | 52/200 |

FOREIGN PATENT DOCUMENTS

| | | | | |
|---|---|---|---|---|
| 17957 | * | of 1895 | (GB) | 52/3 |
| 966299 | * | 8/1964 | (GB) | 52/200 |

* cited by examiner

*Primary Examiner*—Blair M. Johnson
(74) *Attorney, Agent, or Firm*—Richard W. Collins

(57) ABSTRACT

A skylight protector having a support frame covered by a protective mesh and including positioning members for positioning the protector relative to a skylight.

5 Claims, 1 Drawing Sheet

SKYLIGHT PROTECTOR

BACKGROUND OF THE INVENTION

This invention relates to skylight protectors, and more particularly, to skylight protectors that prevent hail damage to skylights installed in residential or commercial building roofs.

In most areas of the country, and particularly in areas subject to frequent severe thunderstorms, it is not uncommon for hailstorms to damage or destroy unprotected skylights in buildings. Destruction of skylights often leads to even more serious water damage to the interior of such buildings. Thus, there is a need for a means of preventing skylight damage, and especially for such a means that is inexpensive, effective and easy to install.

There have been efforts in the past to protect skylights with a wire mesh covering. U.S. Pat. No. 1,236,008 to Rysdon shows a skylight with an integral protective netting built into the skylight. The protective netting as taught by Rysdon has to be included in the initial construction of the skylight.

U.S. Pat. No. 5,237,788 to Sandow shows a skylight guard including a mesh covering for mounting on a skylight frame. The Sandow device is primarily intended to prevent a person from inadvertently falling through the skylight.

U.S. Pat. No. 5,502,934 to Coyne et al shows a skylight protector which again is primarily designed to prevent a person from falling through the skylight.

U.S. Design Pat. No 354,817 shows a skylight protector similar to the one shown in the above-noted Sandow patent.

There is a continuing need for a simple skylight protector that is effective, easily installed, and that can protect a range of skylight sizes.

SUMMARY OF THE INVENTION

The present invention provides a skylight protector that is inexpensive, easily constructed and installed, and effective in protecting a skylight from hail damage. A protector in accordance with this invention can protect a range of sizes of skylights, and does not have to be custom-manufactured for a single size of skylight. The protector includes a support frame including supporting legs, a mesh cover, and positioning means.

DETAILED DESCRIPTION OF THE INVENTION

Figure 1:
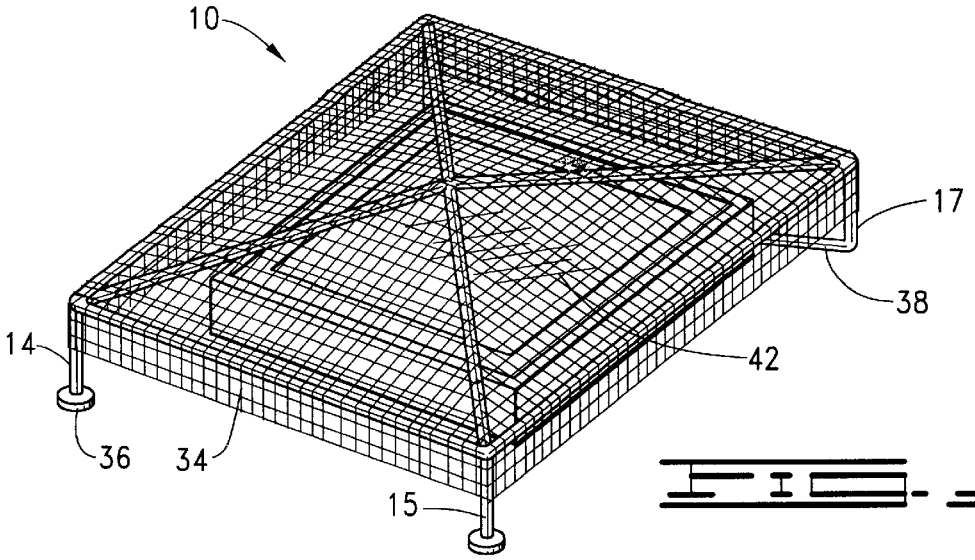
FIG. 1 is a perspective view of a skylight protector in accordance with this invention.
Figure 2:
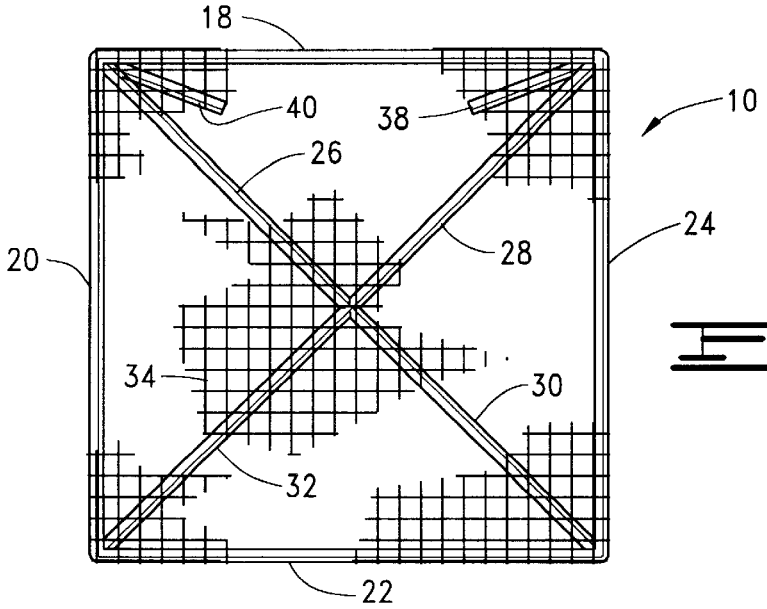
FIG. 2 is a top plan view of the skylight protector.

As shown in FIGS. 1–4 of the drawings, a skylight protector 10 includes a support frame comprised of a pair of lower legs 14 and 15 (FIGS. 1 and 3), a pair of upper legs 16 and 17 (FIGS. 1 and 4), outer frame members 18, 20, 22 and 24 (FIG. 2), and inner frame members 26, 28, 30 and 32 (FIG. 2).

Figure 3:
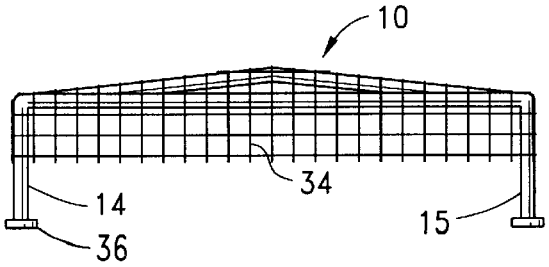
FIG. 3 is a side elevation view from the lower end of the skylight protector.
Figure 4:
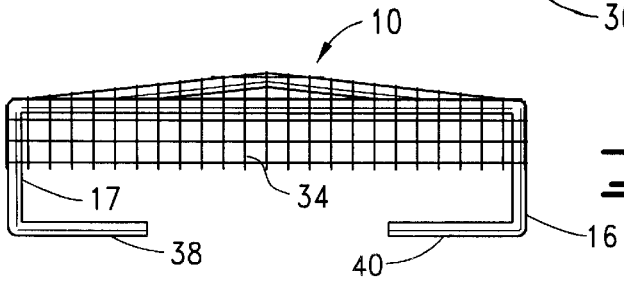
FIG. 4 is a side elevation view from the upper end of the skylight protector.

A mesh covering 34 extends over the inner and outer frame members, and as seen in FIGS. 1, 3 and 4, extends part way down the length of the upper and lower legs.

Lower legs 14 and 15 are shown with pads 36 (FIGS. 1 and 3) to prevent roof damage from contact of the lower legs with the roof.

Positioning members 38 and 40 (FIGS. 1, 2 and 4) are shown as extensions of upper legs 16, and as best seen in FIG. 2 extend inwardly from the periphery of the support frame. As best seen in FIG. 4, positioning members 38 and 40 are formed by making an appropriately directed right angle bend in upper legs 16 and 17.

The support frame may be made of any suitable material, but preferably is formed of steel rods connected by welds.

Mesh cover 34 is preferably a metal wire mesh screen having mesh openings from 1 to 2 centimeters per side. Other materials such as impact-resistant polymeric substances can also be used. The mesh openings are sized to prevent large potentially damaging hailstones from contacting the underlying skylight. Generally, hailstones smaller than about 2 centimeters in diameter are not likely to cause damage. Mesh cover 34 may be attached to the support frame by any suitable means such as welding, adhesive, twist ties or simply a friction fit.

As seen in FIGS. 1, 3 and 4, mesh cover 34 only extends part way down the legs of the protector. This prevents leaves and debris from being trapped between the mesh and the roof.

Preferably, the support frame is slightly higher in the center (FIGS. 3 and 4) to minimize accumulation of leaves and debris on top of the protector.

Operation

The skylight protector of this invention, as shown in FIG. 1, overlies a skylight 42 mounted in a roof (not shown). A feature of the invention is that the protector does not need to be precisely sized for a given skylight, so long as the protector substantially covers the skylight. For example, the skylight 42 in FIG. 1 could be larger than the one shown and still could be effectively protected by the size of the protector shown.

Installation of the protector involves merely placing the protector over the skylight. The positioning members 38 and 40 rest against the upper side of a skylight frame as shown in FIG. 1, and the positioning members prevent the protector from sliding down the roof.

The protector does not need to be fastened to the roof or the skylight. A prototype in actual use has remained in position on a conventional inclined residential roof through several storms including winds in excess of 50 miles per hour.

Because of its exceptional ease of installation, the protector can be removed and stored during all except the potential storm season, or can be left in place year round.

Modifications and variations in the protector as shown and described herein will be apparent to those skilled in the art, and are intended to be within the scope of the invention as defined by the appended claims.

What is claimed is:

1. A skylight protector in combination with a skylight having a frame, said skylight protector comprising:

(a) a support frame formed from metal rods and including a first pair and a second pair of leg members, a plurality of outer frame members and a plurality of inner frame members;

(b) a mesh covering extending over and supported by said outer and inner frame members; and (c) a pair of positioning members contacting said skylight frame when said protector is positioned over a skylight in a roof, said positioning members being extensions of one of said pair of leg members, said positioning members extending inwardly from the periphery of said protector.

2. A skylight protector as defined in claim 1 wherein said mesh member is a semi-rigid member having a grid of openings sized to prevent passage of hailstones greater than about 2 centimeters in diameter.

3. A skylight protector as defined in claim 1 wherein said mesh member is a metal wire mesh member.

4. A skylight protector as defined in claim 1 wherein said leg members extend below said mesh member to provide an opening between said mesh member and a roof on which the protector rests, thereby reducing the tendency of leaves and other debris to be trapped by said protector.

5. A skylight protector as defined in claim 1 wherein the center of said protector is slightly higher than the surrounding portions thereof.

* * * * *